US010119698B2

(12) United States Patent
Roh et al.

(10) Patent No.: US 10,119,698 B2
(45) Date of Patent: Nov. 6, 2018

(54) LED ILLUMINATION DEVICE FOR SPOTLIGHTING

(71) Applicant: KMW INC., Hwaseong-si (KR)

(72) Inventors: Dong-Sik Roh, Seoul (KR); Duk-Yong Kim, Hwaseong-si (KR)

(73) Assignee: GIGATERA INC., Hwaseong-si (KR)

( * ) Notice: Subject to any disclaimer, the term of this patent is extended or adjusted under 35 U.S.C. 154(b) by 0 days.

(21) Appl. No.: 15/624,714

(22) Filed: Jun. 16, 2017

(65) Prior Publication Data

US 2017/0307203 A1 Oct. 26, 2017

Related U.S. Application Data

(63) Continuation of application No. PCT/KR2014/012607, filed on Dec. 19, 2014.

(51) Int. Cl.
*F21V 29/76* (2015.01)
*F21V 23/02* (2006.01)
(Continued)

(52) U.S. Cl.
CPC ..... *F21V 29/76* (2015.01); *F21S 8/003* (2013.01); *F21V 7/04* (2013.01); *F21V 21/14* (2013.01);
(Continued)

(58) Field of Classification Search
CPC ..... F21Y 2115/10; F21Y 2107/40; F21Y 2101/00; F21Y 2107/00; F21Y 2107/30; F21Y 2113/13; F21Y 2107/10
(Continued)

(56) References Cited

U.S. PATENT DOCUMENTS 9,010,969 B2 * 4/2015 Roudeski ..... F21V 23/009 362/241
2013/0107518 A1 * 5/2013 Boyer ..... F21V 29/004 362/235
2013/0329434 A1 * 12/2013 Packard ..... F21V 19/04 362/311.01

FOREIGN PATENT DOCUMENTS

JP 10-255516 A 9/1998
JP 2010-103241 A 5/2010
(Continued)

OTHER PUBLICATIONS

International Search Report for PCT/KR2014/012607, dated Aug. 24, 2015, and its English translation.

*Primary Examiner* — William Carter

(57) ABSTRACT

An LED illumination device for spotlighting includes: a lower case part having a plurality of planar inner side surfaces so that a light-emitting hole on the bottom surface thereof can be a polygonal shape; an upper case part, positioned above the lower case part, for receiving a power supply unit; substrates which are respectively coupled to the planar inner side surfaces of the lower case part and in which LEDs are mounted such that a light-emitting surface can be directed to the central part of the polygon; and a plurality of heat dissipation fins which are protrudingly positioned along the circumference of the lower case part, wherein the spaces between the heat dissipation fins communicate in the longitudinal direction of the lower case part. A case is manufactured as a single structure and components such as a power supply unit, LED-mounted substrates, reflective plates, etc. can be assembled within the case through the light-emitting hole.

9 Claims, 15 Drawing Sheets

(51) Int. Cl.

| | |
|---|---|
| ***F21V 7/04*** | (2006.01) |
| ***H05B 33/08*** | (2006.01) |
| ***F21V 29/505*** | (2015.01) |
| ***F21V 23/00*** | (2015.01) |
| ***F21V 21/14*** | (2006.01) |
| ***F21S 8/00*** | (2006.01) |
| *F21Y 115/10* | (2016.01) |

(52) U.S. Cl.
CPC ..... *F21V 23/001* (2013.01); *F21V 23/02* (2013.01); *F21V 29/505* (2015.01); *H05B 33/0845* (2013.01); *F21Y 2115/10* (2016.08)

(58) Field of Classification Search
USPC ..... 362/368, 373
See application file for complete search history.

(56) References Cited

FOREIGN PATENT DOCUMENTS

| | | | |
|---|---|---|---|
| JP | 2011-060772 | A | 3/2011 |
| JP | 2012-234792 | A | 11/2012 |
| JP | 2012-243481 | A | 12/2012 |
| JP | 2014-154299 | A | 8/2014 |
| KR | 10-2011-0040695 | A | 4/2011 |
| KR | 10-2013-0051247 | A | 5/2013 |
| KR | 10-2014-0103666 | A | 8/2014 |
| KR | 10-2015-0035103 | A | 4/2015 |

* cited by examiner

LED ILLUMINATION DEVICE FOR SPOTLIGHTING

CROSS-REFERENCE TO RELATED APPLICATIONS

This application is a continuation of International Application No. PCT/KR2014/012607 filed on Dec. 19, 2014, the entire contents of which are incorporated herein by reference.

TECHNICAL FIELD

The present disclosure relates to an LED illumination device for spotlighting, and more particularly, to an LED illumination device for spotlighting, capable of being easily assembled and disassembled and reducing manufacturing costs by minimizing the number of parts.

BACKGROUND ART

In recent years, a variety of policies have been proposed to reduce power consumption during the peak time thereof since concerns about blackout are raised in Korea as the power consumption increases. For example, regulations on total energy consumption are enforced for each building to charge a fine if the energy consumption exceeds a reference value, or various methods of changing a lunch break, changing duty uniform regulations, adjusting the service interval between subways, or the like are performed in Seoul city.

As one of methods for reducing a power consumption, there is proposed an illumination device using LEDs with significantly lower power consumption, compared to an existing incandescent or fluorescent lamp. However, it is difficult to commercialize such an LED illumination device because an LED itself is very expensive compared to the incandescent or fluorescent lamp and the LED illumination device is relatively expensive since a heat dissipation structure and a power supply unit are separately provided therein.

In particular, since brighter lighting is required compared to ambient conditions in factories, in which accurate work is performed, or environments in which fine design, assembly, or inspection is performed, spotlight using LEDs has been proposed to adapt to these environments.

An example of a conventional LED illumination device for spotlighting is disclosed in the present applicant's Korean Patent Application Publication No. 10-2013-0051247, entitled "LED illumination device", published on May 20, 2013. The invention disclosed in Korean Patent Application Publication No. 10-2013-0051247 relates to an LED illumination device for spotlighting in which separate power unit and illumination unit housings are provided therein to decouple a power supply unit and an LED source, which generate heat, from each other, and the housings are interconnected through an annular connection frame.

The LED illumination device for spotlighting has a considerable effective structure that can easily dissipate heat and prevent the life shortening of the LED illumination device, the power consumption of which is higher than that of a typical illumination device.

In addition, the LED illumination device for spotlighting is advantageous in that it can adjust light distribution by tilting the illumination unit housing to flexibly cope with a change in working space. However, there is a need for processes of separately manufacturing the power unit housing, the illumination unit housing, and the connection frame, assembling respective parts thereto, and then reassembling the power unit housing, the illumination unit housing, and the connection frame to one another in the LED illumination device for spotlighting. Hence, the LED illumination device is disadvantageous in that its cost increases due to an increase in production cost, and especially a lot of times and manpower consumed in the assembly processes.

DISCLOSURE

Technical Problem

Accordingly, the present disclosure has been made in view of the above-mentioned problems, and an object thereof is to provide an LED illumination device for spotlighting, capable of reducing the number of separately manufactured parts and shortening the time required for assembly.

It is another object of the present disclosure to provide an LED illumination device for spotlighting, capable of effectively dissipating heat generated therein to prevent the lifetime of the LED illumination device from shortening due to the generated heat.

Technical Solution

In accordance with an aspect of the present disclosure, an LED illumination device for spotlighting includes a lower case having a plurality of planar inner surfaces so that a light outlet on a bottom thereof has a polygonal shape, an upper case positioned above the lower case to accommodate a power supply unit therein, substrates coupled to the respective planar inner surfaces of the lower case and having LEDs mounted thereon such that light-emitting surfaces of the LEDs are directed to a central of the polygonal light outlet, and a plurality of heat dissipation fins protruding along a circumference of the lower case, spaces between the heat dissipation fins being in communication with one another in a vertical direction of the lower case.

Advantageous Effects

An LED illumination device for spotlighting according to the present disclosure is configured such that a case is manufactured as a single structure, and components such as a power supply unit, substrates having LEDs mounted thereon, and a reflector are assembled in the case through a light outlet. Accordingly, it is possible to reduce manufacturing costs and advance the commercialization of the LED illumination device for spotlighting.

In addition, the LED illumination device for spotlighting according to the present disclosure can have high heat dissipation efficiency by positioning heat dissipation fins at the back surfaces of the LED-mounted substrates so that the heat dissipation fins effectively exchanges heat with outside air by airflow generated by heat. Therefore, it is possible to prevent the lifetime of LEDs from shortening due to heat.

Furthermore, the LED illumination device for spotlighting according to the present disclosure can prevent heat conduction between the power supply unit and the LEDs, which generate heat, thereby preventing damage due to the heat conduction.

DESCRIPTION OF THE REFERENCE NUMERALS

| | |
|---|---|
| 100: case, | 110: upper case |
| 111, 112: stepped portion, | 120: lower case |
| 121: heat dissipation fin, | 122: substrate |
| 123: electrode, | 124: LED |
| 150: tilting frame, | 160: port |
| 170: wire, | 180: fixed frame |
| 190: light outlet, | 200: power supply unit |
| 300: thermal insulator, | 310: first thermal insulator |
| 320: second thermal insulator, | 330: air layer |
| 400: reflector, | 410: reflective pocket |
| 420: inclined surface, | 430: through-hole |
| 440: rib, | 500: cover |
| 510: hole, | 600: dimming controller |

Best Mode for Invention

Hereinafter, an LED illumination device for spotlighting according to exemplary embodiments of the present disclosure will be described in detail with reference to the accompanying drawings.

Figure 1:
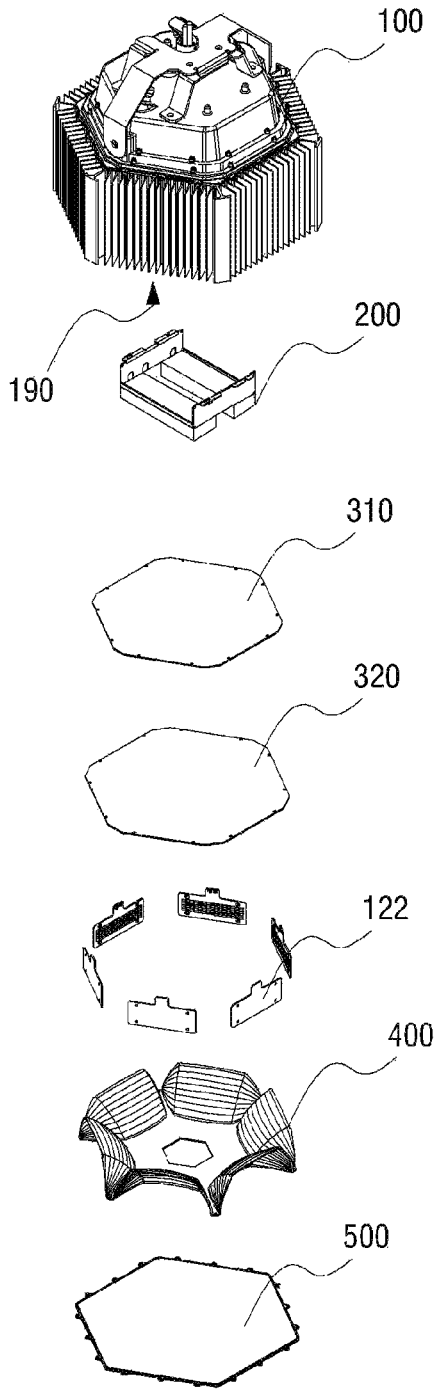
FIG. 1 is an exploded perspective view illustrating an LED illumination device for spotlighting according to an exemplary embodiment of the present disclosure.
Figure 2:
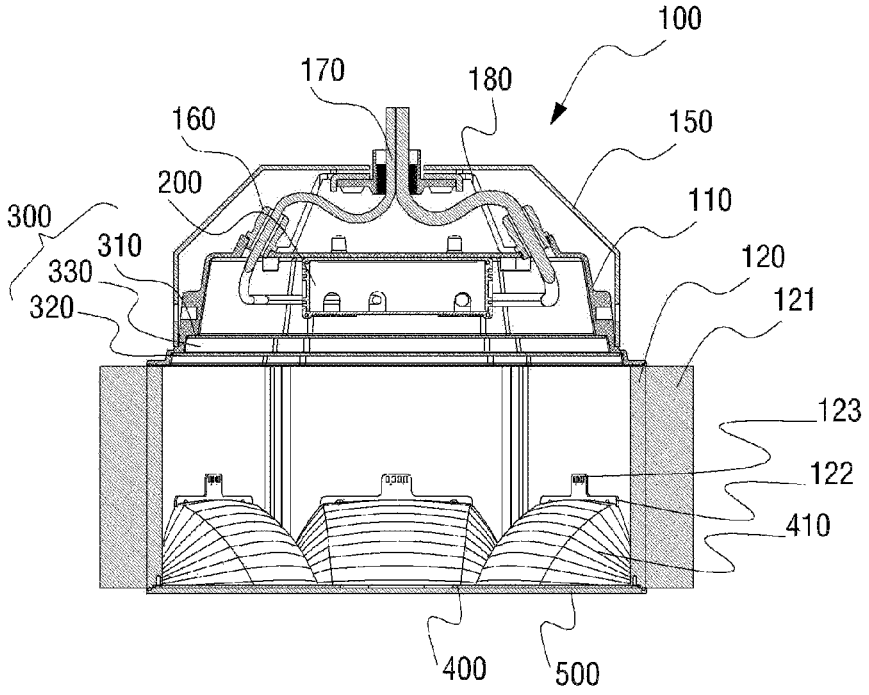
FIG. 2 is a cross-sectional view illustrating an assembled state of the LED illumination device for spotlighting according to the embodiment of the present disclosure.

FIG. 1 is an exploded perspective view illustrating an LED illumination device for spotlighting according to an exemplary embodiment of the present disclosure. FIG. 2 is a cross-sectional view illustrating an assembled state of the LED illumination device in FIG. 1.

Referring to FIGS. 1 and 2, the LED illumination device for spotlighting according to the embodiment of the present disclosure includes a case 100 that has a light outlet 190 formed on the bottom thereof and includes a longitudinal upper case 110 and a lower case 120 positioned beneath the upper case 110 while having a plurality of inner surfaces as planar installation surfaces, a power supply unit 200 that is fixedly coupled through the light outlet 190 inside the upper case 110 of the case 100, a thermal insulator 300 that seals the gap between the upper case 110 and the lower case 120 to prevent heat conduction therebetween, a plurality of substrates 122 that are installed on the respective installation surfaces of the lower case 120 and have LEDs, the light-emitting surfaces of which are perpendicular to the installation surfaces, a reflector 400 that covers the light outlet 190 at the bottom of the lower case 120 and includes reflective pockets 410 for reflecting light of the LEDs mounted on the substrates 122 to emit the light through the bottoms thereof, and a cover 500 that is installed on the bottom of the lower case 120 to diffuse the light emitted through the reflective pockets 410.

Hereinafter, the configuration and operation of the LED illumination device for spotlighting according to the embodiment of the present disclosure will be described in more detail.

First, the case 100 includes the longitudinal upper case 110 that is disposed at the upper side thereof and has a circular cross-section in the horizontal direction in FIG. 2, and the lower case 120 that is disposed beneath the upper case 110 so as to be integral with or separated from the upper case 110.

Although the lower case 120 is illustrated to have a hexagonal cross-sectional shape in the horizontal direction in FIG. 2, the structure thereof may be changed as occasion demands. The lower case 120 must necessarily have a planar installation surface as an inner surface. Although the lower case 120 is illustrated to have six installation surfaces in the drawing, the number of installation surfaces thereof may be changed as occasion demands.

That is, the lower case 120 has three or more installation surfaces, but the number of installation surfaces thereof may be variously changed. For example, the lower case 120 may have eight or twelve installation surfaces considering the areas of the substrates since the lower case has a shape close to the circle if the number of installation surfaces is increased.

The lower case 120 has a plurality of heat dissipation fins 121 formed on the outer surface thereof, and the heat dissipation fins 121 protrude in a direction perpendicular to the inner installation surfaces of the lower case 120. The heat dissipation fins 121 each have an elongated shape in the height direction of the lower case 120, and are arranged at regular intervals along the circumference of the lower case 120.

The heat dissipation fins 121 have a structure that allows the case 100 to be easily extruded and molded. In addition, the spaces between the heat dissipation fins 121 are vertically elongated so that the convection of ascending airflow generated when heat is radiated may be smooth through the spaces between the heat dissipation fins 121, thereby increasing heat dissipation efficiency.

The upper case 110 has at least one port 160 formed on the upper surface thereof to introduce an external wire 170 thereinto. Both ends of a tilting frame 150 are coupled to two facing sides of the upper case 110 such that the tilting frame 150 is rotatable to tilt the case 100.

The tilting frame 150 is coupled to the upper case 110 by bolts, and serves to adjust the tilting of the case 100 by loosening the bolts and to fix the tilted state thereof by tightening the bolts.

In addition, the upper case 110 has a fixed frame 180 formed at the upper side thereof such that the wire 170 connected to the port 160 is directed to the center and is connected to a wire (not shown) at the ceiling thereof in order to smoothly tilt the case 100.

As described above, the case 100 may include the upper and lower cases 110 and 120 that are manufactured integrally with each other, or may be manufactured by producing and coupling at most two parts to each other. Accordingly, the present disclosure can shorten the working time required for assembly by reducing the number of parts, compared to a conventional method of manufacturing a power unit housing, a connection frame, and a plurality of illumination unit housings.

In addition, all components may be directly coupled to the case 100 in the present disclosure. Therefore, it is possible to remove conventional processes of coupling a power unit housing and a plurality of illumination unit housings to a connection frame again in the state in which the power unit housing is covered with a cover after a power supply unit is coupled to the power unit housing, and the cover or a diffusion plate is coupled after illumination units are installed in the illumination unit housings.

Figure 3:
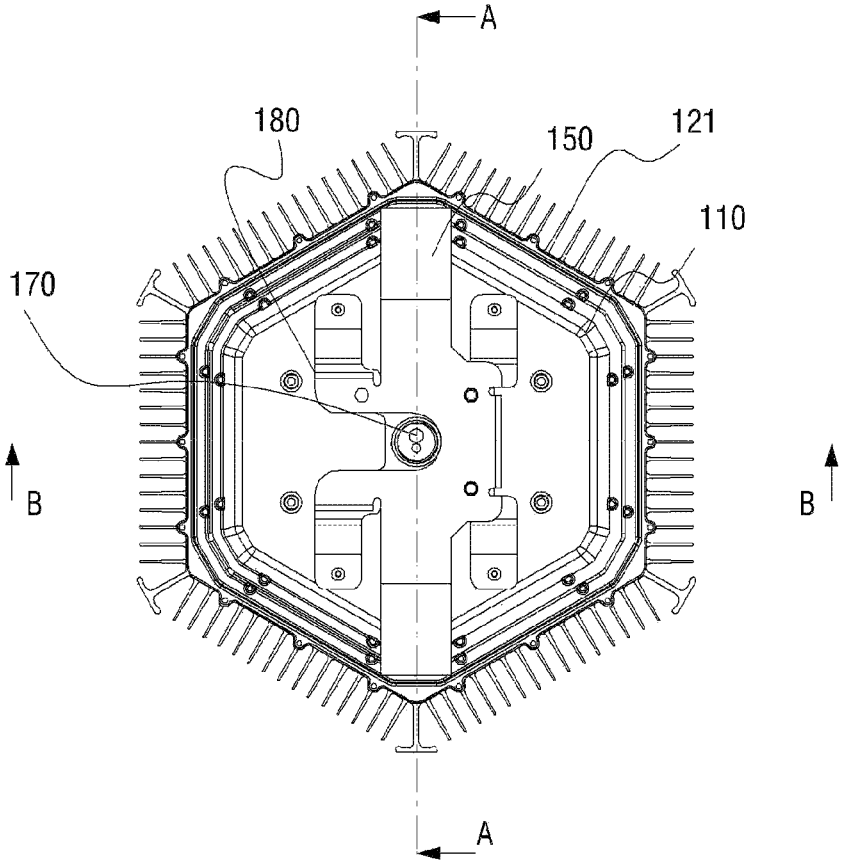
FIG. 3 is a top view illustrating the LED illumination device for spotlighting according to the embodiment of the present disclosure.

FIG. 3 is a top view illustrating the LED illumination device for spotlighting according to the embodiment of the present disclosure. FIGS. 4, 5, 6 and 7 are cross-sectional views illustrating an assembly sequence when viewed from direction "A-A" in FIG. 3.

Figure 4:
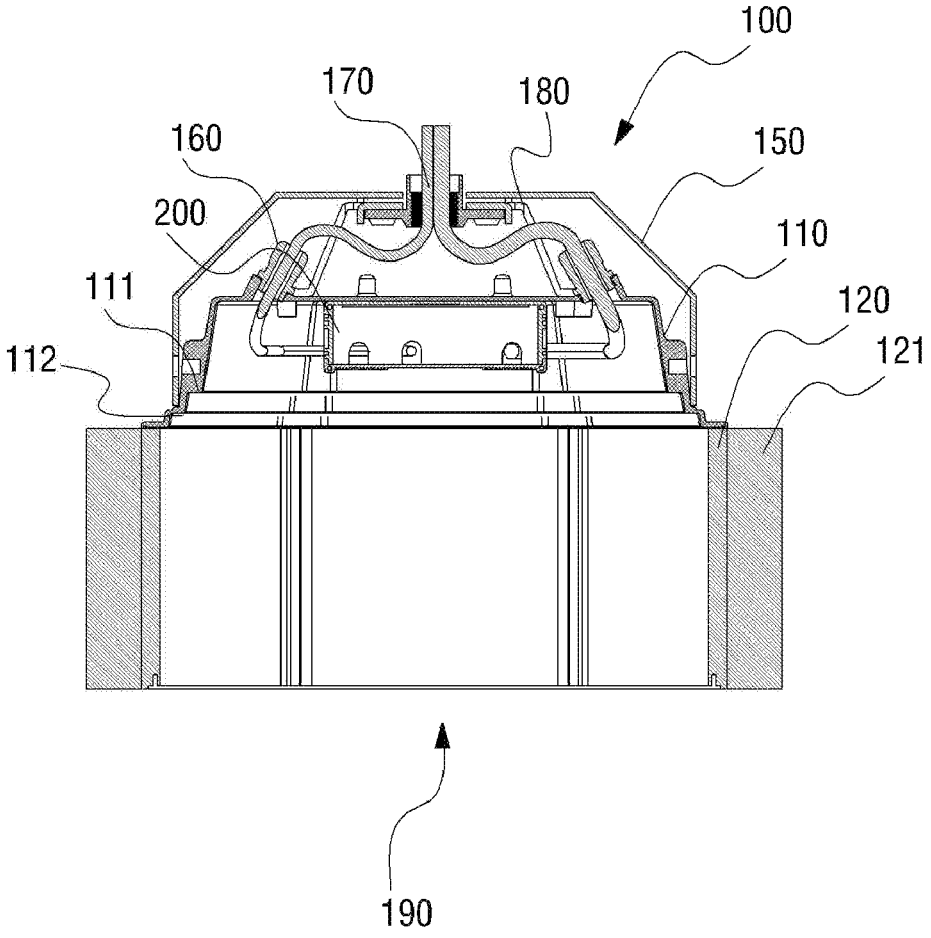
FIGS. 4, 5, 6 and 7 are cross-sectional views illustrating an assembly sequence when viewed from direction "A-A" in FIG. 3.

Referring to FIG. 4, the power supply unit 200 is first inserted into the case 100 through the light outlet 190 of the case 100, and is fixed to the innermost upper surface of the upper case 110. In this case, the wire 170 for supplying AC power to the upper case 110 is discharged through the port 160 to the outside, and extends upward through the fixed frame 180 in the outside.

Figure 5:
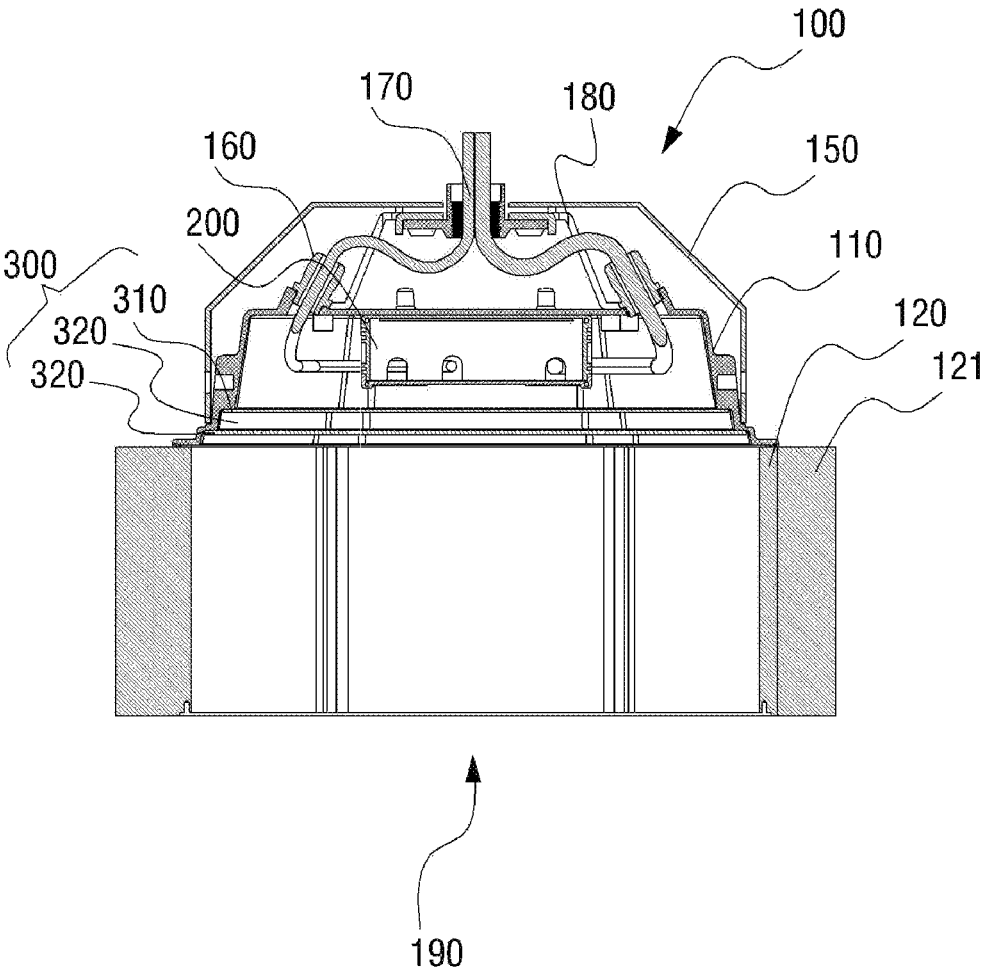

Next, the thermal insulator 300 is inserted through the light outlet 190 of the case 100, and is coupled to the boundary portion between the upper case 110 and the lower case 120, as illustrated in FIG. 5.

The upper case 110 has a plurality of stepped portions 111 and 112 formed at the lower side thereof. In this case, the two stepped portions 111 and 112 may be provided at different positions such that disk-type first and second thermal insulators 310 and 320 having different diameters are coupled thereto, and a gap may be formed between the stepped portions 111 and 112 in the height direction thereof so that an air layer 330 is defined between the first thermal insulator 310 and the second thermal insulator 320.

Accordingly, it is possible to prevent heat conduction between the power supply unit 200 accommodated in the upper case 110 and the LEDs accommodated in the lower case 120 using the first and second thermal insulators 310 and 320 and the air layer 330 therebetween.

Although not illustrated in the drawings, a through-hole may be formed in a portion of each of the first and second thermal insulators 310 and 320 such that wires for supplying DC power of the power supply unit 200 to electrodes 123 of the substrates 122 are connected through the thermal insulator 300.

Figure 6:
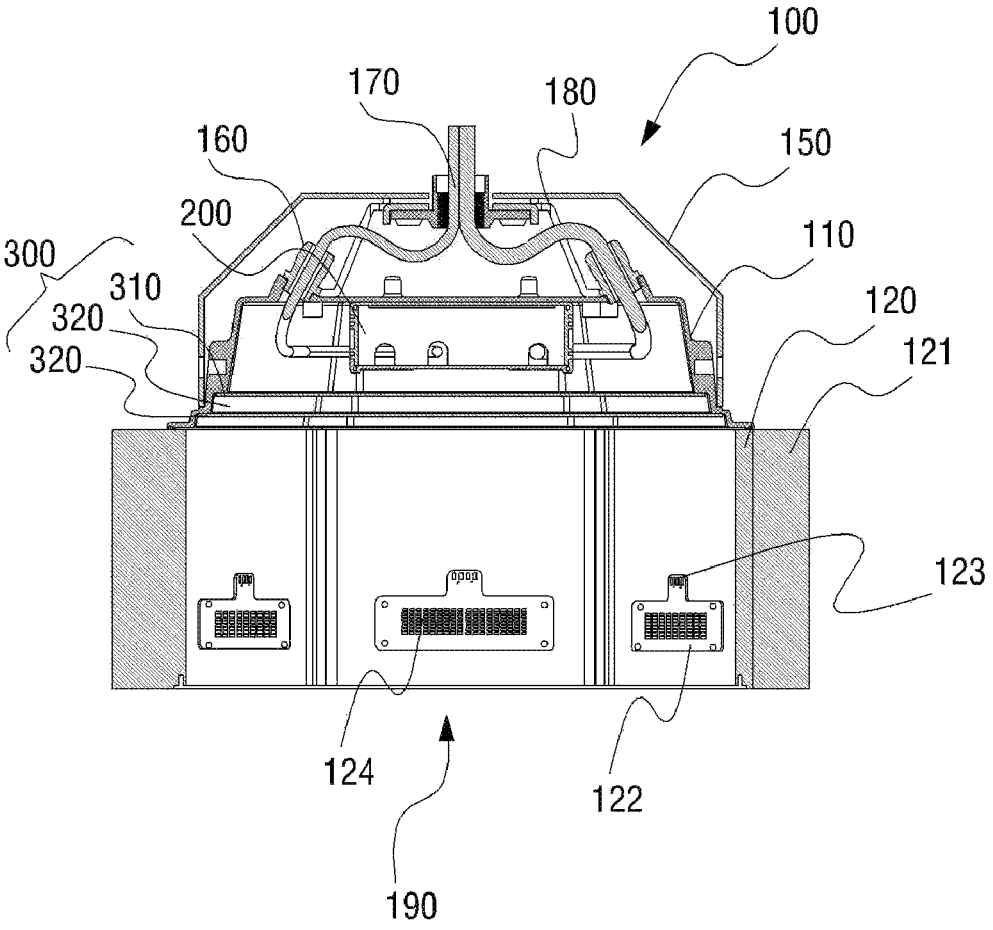

Next, the substrates 122 having the LEDs 124 mounted thereon are inserted through the light outlet 190, and are fixedly installed on the planar installation surfaces that are the inner surfaces of the lower case 120, as illustrated in FIG. 6.

As described above, the lower case 120 has a polygonal shape in at least the inner portion thereof when viewed from the bottom, wherein the number of sides of the polygonal lower case matches the number of installation surfaces, and the substrates 122 are fixedly installed to the respective installation surfaces.

In this case, the substrates 122 are installed such that their electrodes 123 are directed toward the thermal insulator 300, and the LEDs 124 are installed such that their light-emitting surfaces are directed toward the center of the polygonal lower case 120 when viewed from the bottom.

The heat of the substrates 122 having the LEDs 124 mounted thereon is dissipated by the heat dissipation fins 121 arranged on the outer surface of the lower case 120. As described above, the spaces are vertically defined between the heat dissipation fins 121 for easy heat dissipation.

Figure 7:
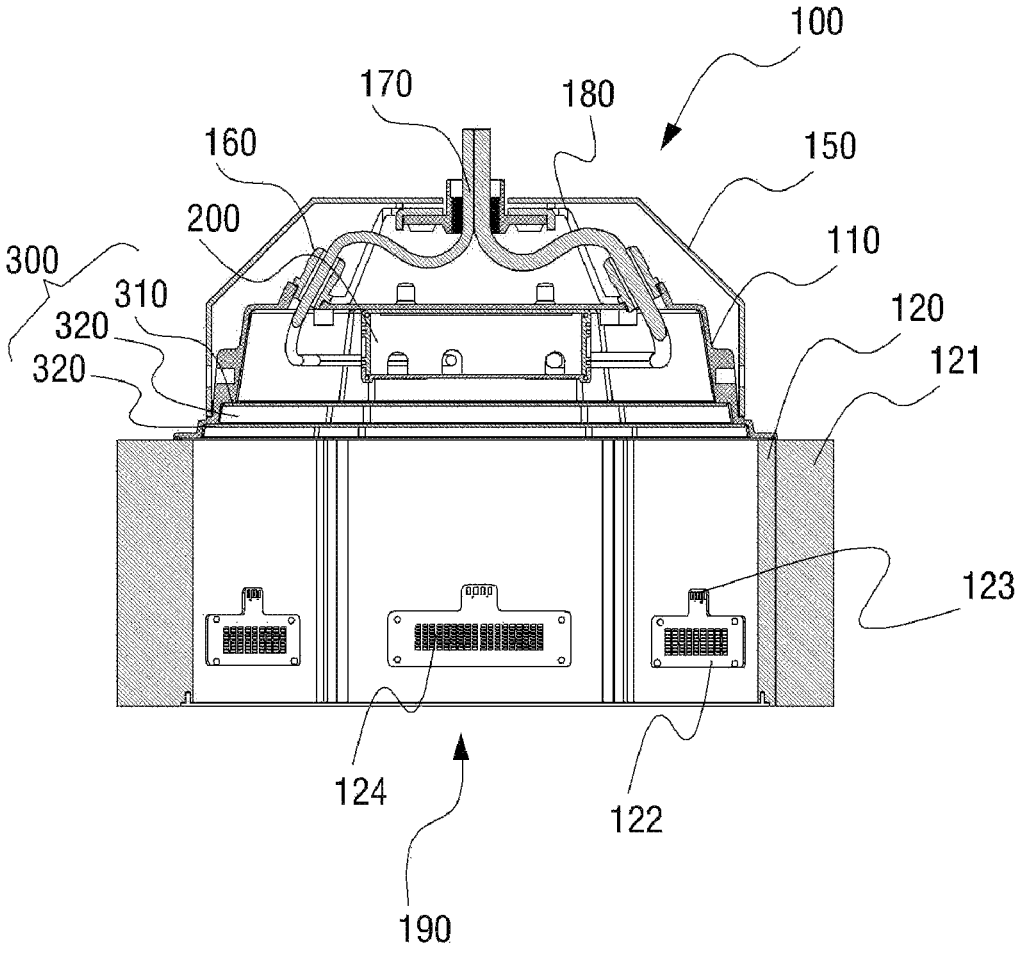

Next, the reflector 400 is inserted through the light outlet 190 and is fixed to the lower case 120, as illustrated in FIG. 7.

The reflector 400 is a polygonal plate having the same number of sides as the lower case 120. In the coupled state of the reflector 400, the reflector 400 is configured such that the reflective pockets 410 surround the substrates 122, the electrodes 123 are exposed upward, and the LEDs 124 are exposed downward.

Each of the reflective pockets 410 has a curved reflective surface, in which case the curvature thereof is a factor that determines light distribution. That is, it is possible to adjust light distribution by replacing reflective pockets 410 having different curvatures with one another.

Thus, since the reflective pockets 410 are used in the present disclosure, there is no need to manufacture a separate illumination unit housing as in the related art. Therefore, it is possible to achieve spotlighting by adjusting the light distribution of the LEDs 124 mounted on the substrates 122.

Accordingly, the present disclosure can implement the commercialization of the LED illumination device in virtue of the low price thereof.

Figure 8:
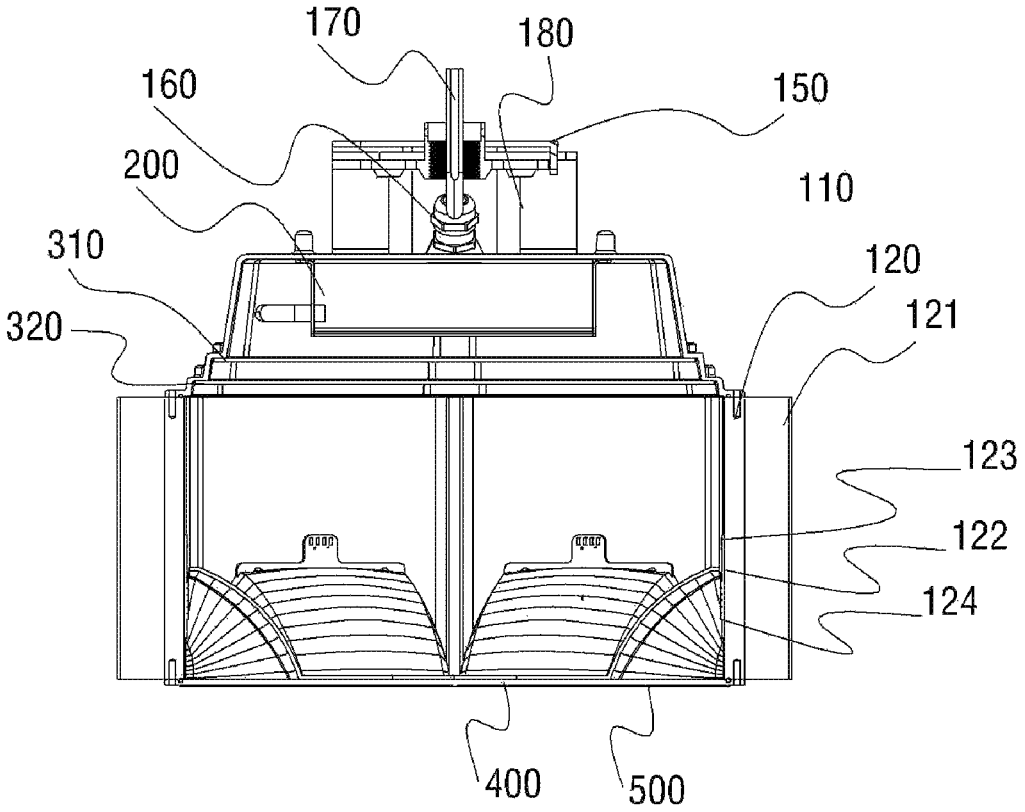
FIG. 8 is a view illustrating an assembled state of a reflector when viewed from direction "B-B" in FIG. 3.

FIG. 8 is a cross-sectional view taken along direction "B-B" in FIG. 3.

Referring to FIG. 8, the reflector 400 including the reflective pockets 410 is not fixed into the lower case 120, but is fixedly installed to the lower end of the lower case 120 by bolts for easy installation of the reflective pockets 410.

Next, the cover 500 is coupled to the lower case 120 to cover the light outlet 190. The cover 500 may be a transparent plate that transmits light or a diffusion plate that diffuses light.

Figure 9:
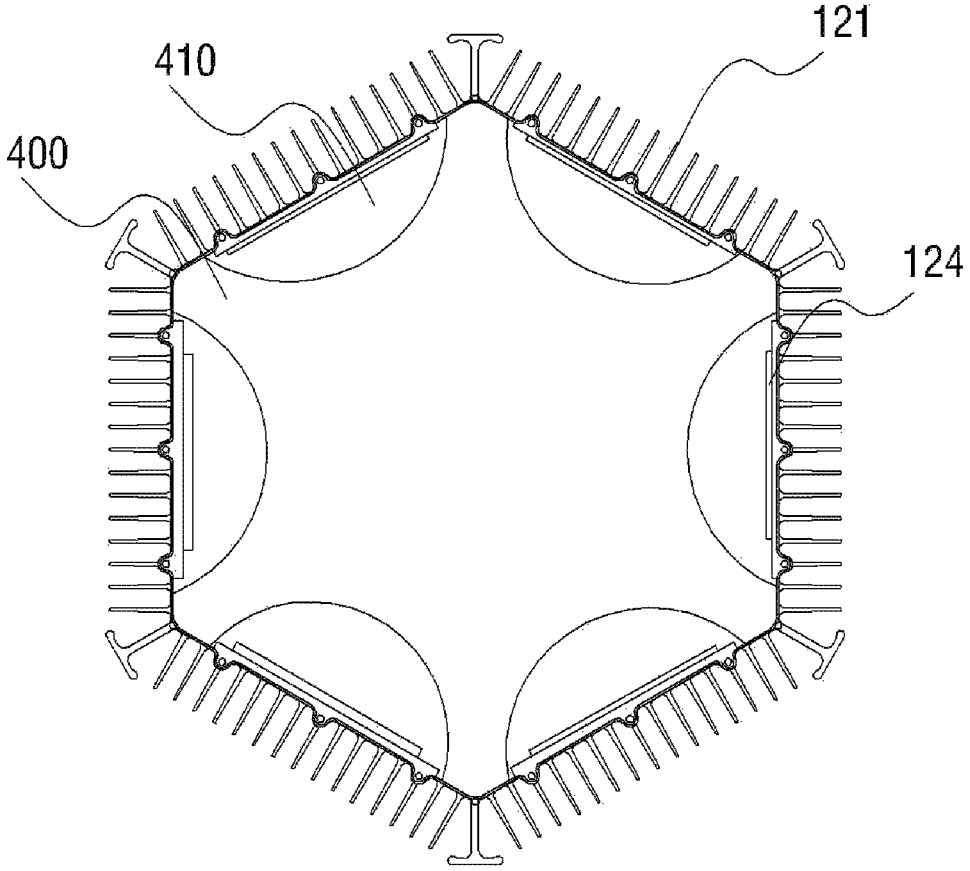
FIG. 9 is a bottom view schematically illustrating a main portion of the LED illumination device for spotlighting according to the embodiment of the present disclosure.

FIG. 9 is a bottom view schematically illustrating a main portion of the LED illumination device for spotlighting according to the embodiment of the present disclosure.

As illustrated in FIG. 9, the LED illumination device for spotlighting according to the embodiment of the present disclosure includes the lower case 120 having polygonal inner surfaces, the substrates 122 that are coupled to the inner surfaces of the lower case and have the LEDs 124 mounted thereon to emit light toward the center of the lower case 120 in the drawing, the heat dissipation fins 121 that protrude outward from the lower case 120 and are arranged at a predetermined interval along the circumference of the lower case 120, and the reflector 400 that is integrally provided to reflect the light emitted from the LEDs 124 and emit the reflected light through the bottom of the lower case 120.

Through such a configuration, it is possible to substantially implement an LED illumination device for spotlighting including a plurality of illumination unit housings to have a maximum simple structure. Therefore, it is possible to increase productivity and lower manufacturing costs by reducing the number of parts and simplifying an assembly process.

In addition, the heat dissipation fins 121 are arranged on the back surfaces of the substrates 122 to directly radiate heat, and the spaces between the heat dissipation fins 121 are vertically open so as not to disturb the convection of air formed in the vertical direction by heat. Therefore, it is possible to enhance heat dissipation efficiency.

Figure 10:
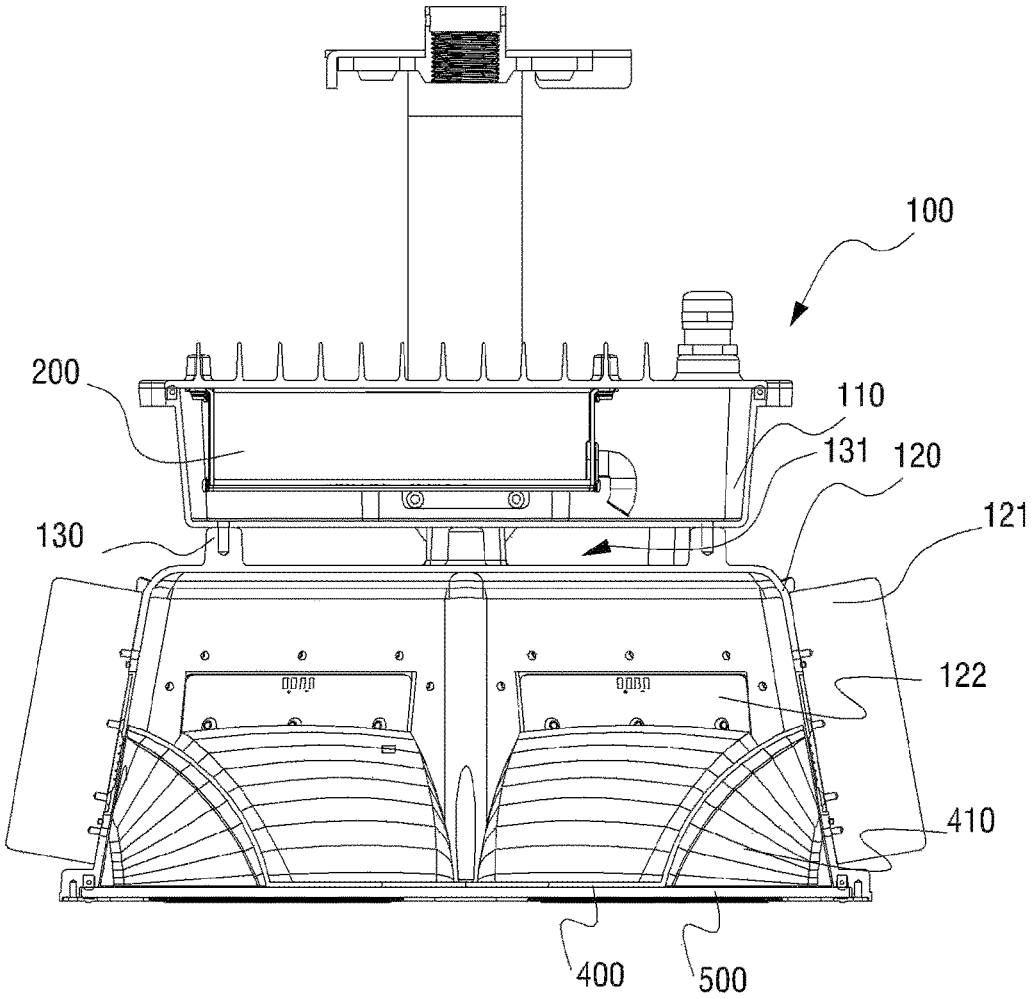
FIG. 10 is a cross-sectional view illustrating a configuration of an LED illumination device for spotlighting according to another embodiment of the present disclosure.

FIG. 10 is a cross-sectional view illustrating a configuration of an LED illumination device for spotlighting according to another embodiment of the present disclosure.

Referring to FIG. 10, in the LED illumination device for spotlighting according to another embodiment of the present disclosure, upper and lower cases 110 and 120 may be separately manufactured, and then be interconnected by a connection member 130, so that a space portion 131 is defined between the upper case 110 and the lower case 120. In the present embodiment, the upper case 110 provided with a power supply unit 200 therein and the lower case 120 provided with a reflector 400 and substrates 122 therein are configured in a separated manner, without using the thermal insulator 300 of the above-mentioned embodiment, thereby preventing heat conduction between the power supply unit 200 and the substrates 122.

In addition, heat dissipation fins 121 arranged on the side of the lower case 120 may be modularized to be coupled to the side of the lower case 120.

In the LED illumination device for spotlighting according to another embodiment of the present disclosure having such a configuration, the time required to assembly components may be increased due to an increase in the number of independent components, compared to the above-mentioned embodiment. However, the LED illumination device for spotlighting according to the present embodiment is advantageous in that it can prevent heat conduction between the power supply unit 200 and the substrates 122 having LEDs 124 mounted thereon and it can achieve preferable maintenance of the power supply unit 200 or the substrates 122.

In addition, since the heat dissipation fins 121 are modularized and manufactured as a separate component, it is possible to use the same modularized heat dissipation fins 121 regardless of a change in shape or size of the lower case 120 and to more easily manufacture the LED illumination device by simplifying the structure of the lower case 120 itself.

Figure 11:
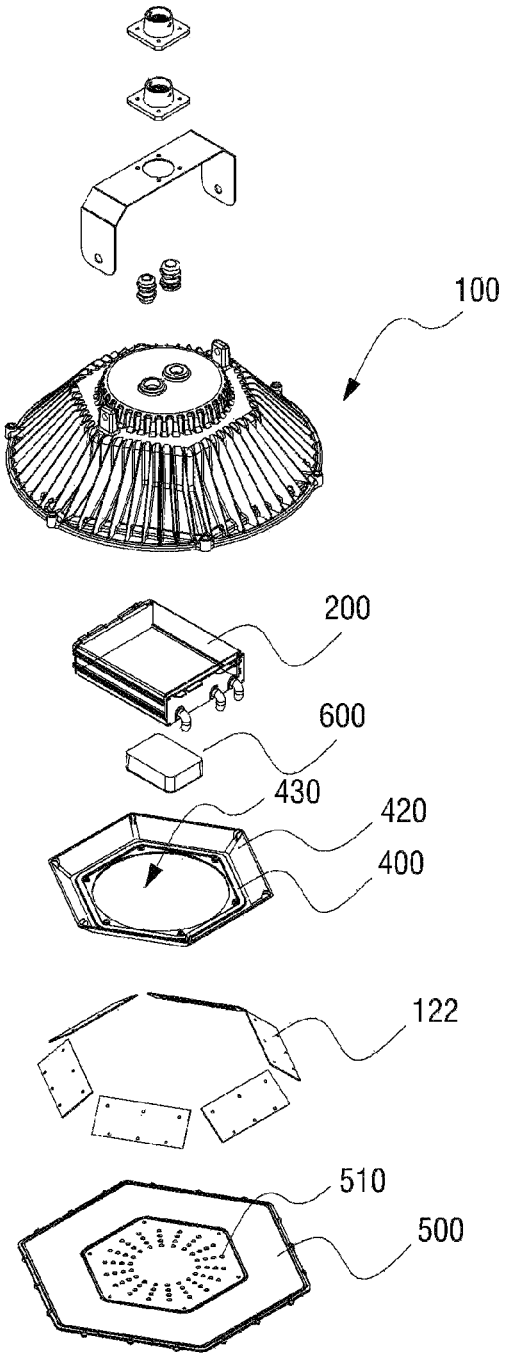
FIG. 11 is an exploded perspective view illustrating an LED illumination device for spotlighting according to a still another embodiment of the present disclosure.
Figure 12:
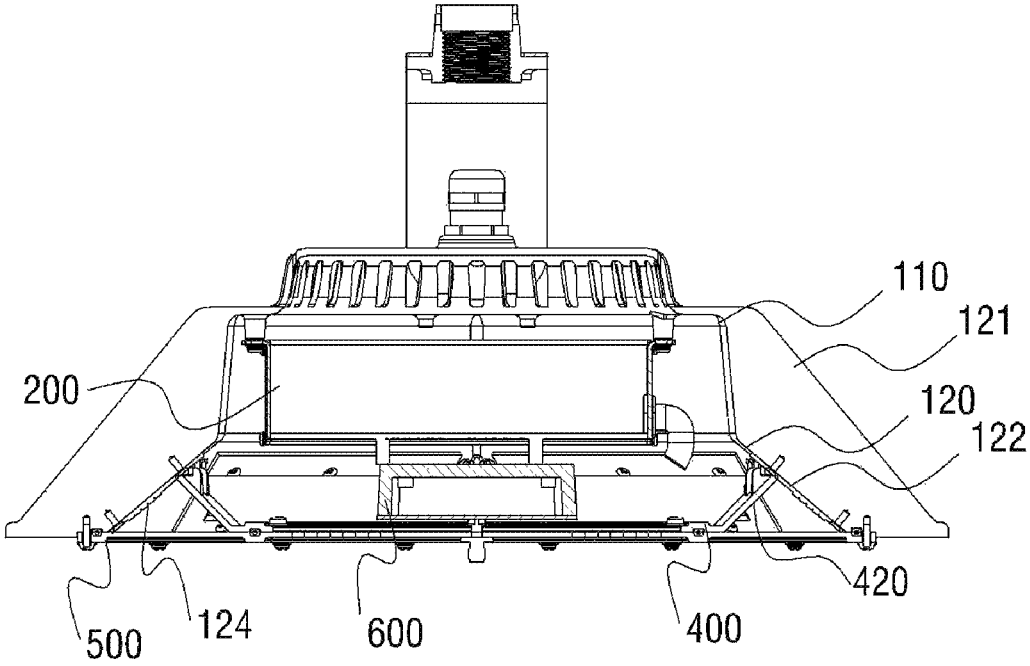
FIG. 12 is a cross-sectional view illustrating an assembled state of the LED illumination device in FIG. 11.

FIG. 11 is an exploded perspective view illustrating an LED illumination device for spotlighting according to a still another embodiment of the present disclosure. FIG. 12 is a cross-sectional view illustrating an assembled state of the LED illumination device in FIG. 11.

Referring to FIGS. 11 and 12, the LED illumination device for spotlighting according to the still another embodiment of the present disclosure includes a case 100, a power supply unit 200, a reflector 400, substrates 122, and a cover 500. In particular, the LED illumination device further includes a dimming controller 600 that is provided at the lower side of the power supply unit 200 and is exposed downward through a through-hole formed in the center of the reflector 400.

The case 100 includes upper and lower cases 110 and 120 that are formed integrally with each other, and a plurality of heat dissipation fins 121 are arranged on the outer surface of the lower case 120. The case 100 may have polygonal planar installation surfaces as bottom inner surfaces, and have a circular shape in appearance.

The case 100 has a light outlet 190 formed on the bottom thereof, the power supply unit 200 is fixedly installed into the case 100 through the light outlet 190, and the dimming controller 600 is installed to control electric power supplied from the power supply unit 200 to the substrates 122 in response to external control signals.

Next, the reflector 400 is fixedly installed to the case 100 through the light outlet 190.

The reflector 400 has inclined surfaces 420, the number of which matches the number of planar installation surfaces of the case 100, without using the reflective pockets 400 of the above-mentioned embodiment. The reflector 400 is configured such that the light of LEDs 124 is reflected from the bottoms of the inclined surfaces 420 to be emitted through the light outlet 190.

In addition, the reflector 400 may have a through-hole 430 formed in the center thereof so that the dimming controller 600 is exposed downward from the reflector 400. This enables the dimming controller 600 to easily receive external wireless signals.

Next, the substrates 122 having the LEDs 124 mounted thereon are fixedly installed on the inner planar installation surfaces of the lower case 120 at the lower sides of the inclined surfaces 420 of the reflector 400.

Next, the cover 500 is installed to the light outlet 190. The cover 500 may have a plurality of holes 510 formed in the center thereof to easily transmit wireless signals to the dimming controller 600.

As such, the LED illumination device according to the present embodiment may further include the dimming controller 600 for easy dimming control from the outside, and each component may be mounted through the light outlet 190 of the case 100 having a single structure. Therefore, it is possible to enhance productivity by reducing manufacturing costs and shortening the time required for the assembly process.

Figure 13:
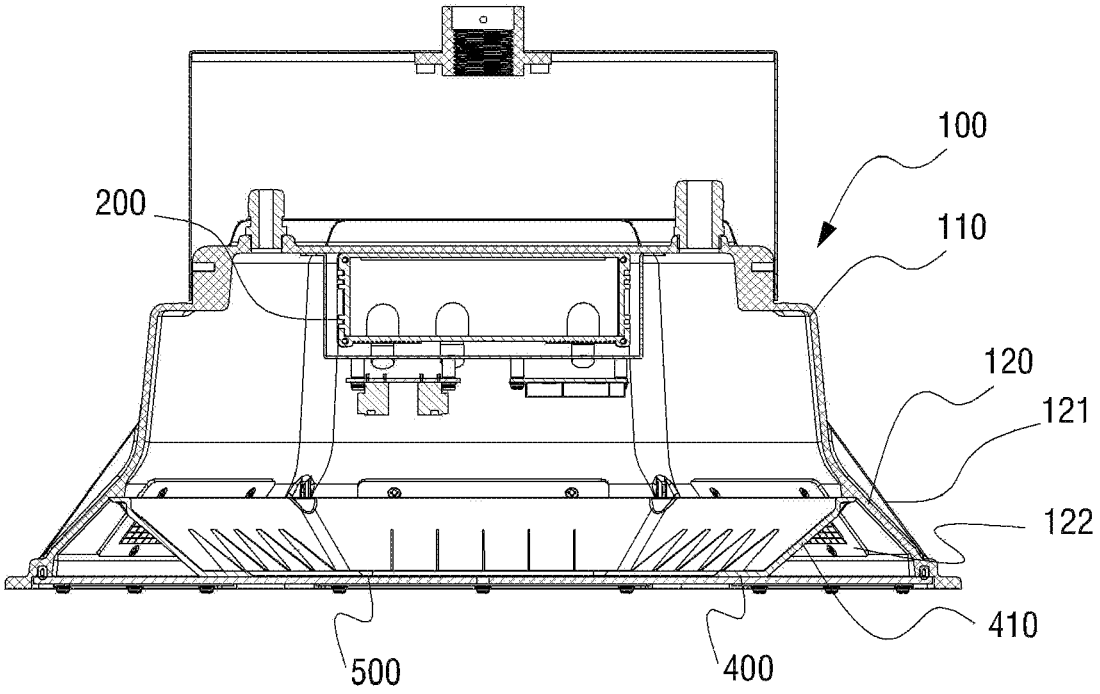
FIG. 13 is a cross-sectional view illustrating a configuration of an LED illumination device for spotlighting according to a further embodiment of the present disclosure.
Figure 14:
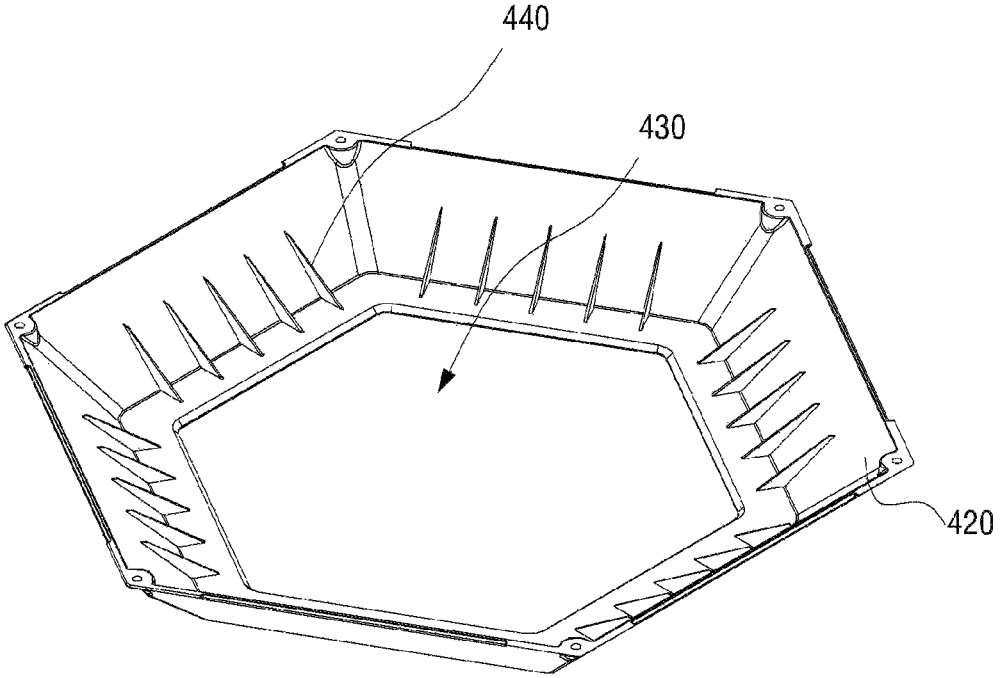
FIG. 14 is a perspective view illustrating a reflector applied to the LED illumination device in FIG. 13.

FIGS. 13 and 14 are a cross-sectional view illustrating a configuration of an LED illumination device for spotlighting according to a further embodiment of the present disclosure and a perspective view illustrating a reflector.

Referring to FIGS. 13 and 14, the LED illumination device for spotlighting according to the further embodiment of the present disclosure includes a case 100 including upper and lower cases 110 and 120 formed integrally with each other, and a plurality of heat dissipation fins 121 arranged on the side of the lower case 120, as described above with reference to FIG. 2.

In such a structure, a power supply unit 200 may be inserted and fixed into the upper case 110 from the lower side of the lower case 120. Of course, a dimming controller may also be inserted and fixed into the upper case 110 as in the above-mentioned embodiment.

In such a structure, a reflector 400 has inclined surfaces 420 for reflective pockets 410 so as to correspond to respective substrates 122, and a plurality of ribs 440 may be arranged at the upper sides of the inclined surfaces 420. The reflector 400 has a through-hole 430 formed in the center thereof. Since the structure and function of the through-hole 430 are sufficiently described in the above-mentioned embodiments, a detailed description thereof will be omitted.

The structure and rigidity of the reflector 400 can be secured by the ribs 440, with the consequence that heat dissipation can be more enhanced by enlarging the surface area of the reflector 400 itself.

Figure 15:
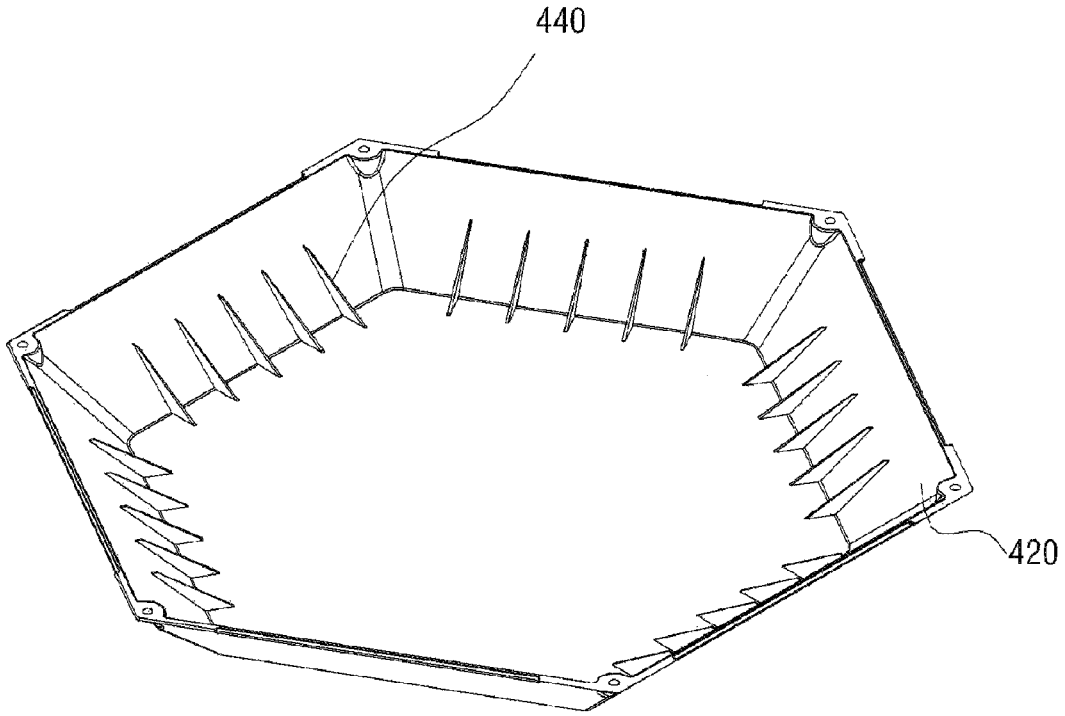
FIG. 15 is a perspective view illustrating another example of a reflector that is applicable to the LED illumination device in FIG. 13.

FIG. 15 is a perspective view illustrating another example of a reflector that is applicable to the LED illumination device in FIG. 13.

Referring to FIG. 15, it can be seen that a reflector 400 has a structure in which the trough-hole 430 of the reflector 400 illustrated in FIG. 14 is removed. The reason is that the dimming controller may easily receive wireless signals when the reflector is made of a material that does not interfere with wireless signals even though the reflector 400 does not have the through-hole 430.

Although the present disclosure has been described with respect to the illustrative embodiments, it will be apparent to those skilled in the art that various variations and modifications may be made without departing from the spirit and scope of the invention as defined in the following claims.

What is claimed is:

1. An LED illumination device for spotlighting, comprising:

a lower case having a plurality of planar inner surfaces so that a light outlet on a bottom thereof has a polygonal shape;

an upper case positioned above the lower case to accommodate a power supply unit therein;

substrates coupled to the respective planar inner surfaces of the lower case and having LEDs mounted thereon such that light-emitting surfaces of the LEDs are directed to a center of the polygonal light outlet;

a reflector coupled to cover the light outlet of the lower case;

a dimming controller configured to control electric power of the power supply unit in response to an external control signal and to supply the controlled electric power to the substrates; and a plurality of heat dissipation fins protruding along a circumference of the lower case, spaces between the heat dissipation fins being in communication with one another in a vertical direction of the lower case, wherein the reflector has a through-hole through which the dimming controller is exposed downward.

2. The LED illumination device according to claim 1, wherein the reflector comprises a plurality of reflective pockets to individually expose the LEDs mounted on the substrates toward the light outlet.

3. The LED illumination device according to claim 2, further comprising a thermal insulator configured to prevent heat conduction between the upper case and the lower case.

4. The LED illumination device according to claim 3, wherein the thermal insulator comprises first and second thermal insulators that are vertically disposed, and an air layer is defined between the first thermal insulator and the second thermal insulator.

5. The LED illumination device according to claim 2, wherein the reflector has a plurality of ribs arranged on an upper surface thereof to reinforce the reflector and enlarge a surface area of the reflector for easy heat dissipation.

6. The LED illumination device according to claim 1, wherein the reflector has a plurality of inclined surfaces to individually expose the LEDs mounted on the substrates toward the light outlet.

7. The LED illumination device according to claim 6, wherein the reflector has a plurality of ribs arranged on an upper surface thereof to reinforce the reflector and enlarge a surface area of the reflector for easy heat dissipation.

8. The LED illumination device according to claim 1, wherein the upper and lower cases are connected by a connection member so that a space portion is defined therebetween.

9. The LED illumination device according to claim 8, wherein the heat dissipation fins are separately manufactured to be coupled to the outside of the lower case.

* * * * *